US005145418A

United States Patent [19]

Moranski et al.

[11] Patent Number: 5,145,418

[45] Date of Patent: Sep. 8, 1992

[54] TERMINAL BLOCK SEGMENT WITH FEET FOR MOUNTING ON TRACKS OF TWO DIFFERENT WIDTHS

[75] Inventors: Jeffrey A. Moranski, New Berlin; Ronald J. Malecki, Brown Deer; Mark E. Davidsz, Greenfield; Arthur J. Felber, Muskego, all of Wis.

[73] Assignee: Allen-Bradley Company, Inc., Milwaukee, Wis.

[21] Appl. No.: 712,013

[22] Filed: Jun. 7, 1991

[51] Int. Cl.[5] ..... H01R 9/26

[52] U.S. Cl. ..... 439/716; 439/712

[58] Field of Search ..... 439/712, 715, 716

[56] References Cited

U.S. PATENT DOCUMENTS

| | | | |
|---|---|---|---|
| 3,236,975 | 2/1966 | DeSmidt et al. | 439/716 |
| 4,113,982 | 9/1978 | Glaesel | 439/716 |
| 5,090,922 | 2/1992 | Rymer et al. | 439/716 |

OTHER PUBLICATIONS

International Electrotechnical Commission Standard 17B: "Low-Voltage Switchgear and Controlgear", Mar. 1978.
Amerace Corporation: "Buchanan Metric Terminal Blocks", pp. 2 and 14, Sep., 1978.
Amerace Corporation Publication, Jun. 1987.
Fuji Electric Co. Ltd. 07 individual Catalog: "Terminal Blocks FNb 220", 1982.
Conta-Clip Catalog, p. 3, undated.
Telemecanique AB-1 Terminal Block Data Sheet, undated.
Woertz Terminal Design, (2 pages), undated.
Entrelec: "Series 5000 Terminal Blocks", (2 pages), Apr., 1985.
Square D Company Catalog, pp. GA3, GA6, GP3 and GP6,: "Terminal Blocks", undated.
Curtis Industries, Inc.: "Series SW 5000", catalog, pp. 24-25, 1988.
Entrelec: "Functional Terminal Blocks for Programmable Controller System", brochure, May, 1988.
Entrelec "Verbindungstechnik-Installation", brochure, undated.
Connectron, Inc.: "NFT Terminal Blocks", p. 3, undated.
Marathon, Inc.: "Sectional Terminal Blocks", p. 97, Apr., 1990.
EMM, Inc.: "Rail Mounting Type Terminal Blocks", 1982.
Thomas & Betts Corporation: "Electro-Block Rail--Mounted Terminal Blocks", 1 page, 1982.
Schegle Elektrokontakt: "Terminal Blocks", 1 page, undated.
Underwriters Safety Device: "600 V Sectional Terminal Blocks", p. 24, undated.
Wiedmuller: "Terminal Blocks", brochure, undated.
Kulka: "International Series High Density Terminal Blocks", catalog, undated.
Wieland Bamberg Catalog, Jun., 1984.
Wiedmüller: "Terminal Block Technology", 1981.
Wiedmüller Terminal Blocks Connection Systems Data Sheet, Jan., 1989.
Allen-Bradley "Bulletin 1492 Terminal Blocks", 1492-1.0, Oct., 1988.
Phoenix Contact Catalog, undated.
Wago Catalog 1978/1980-K2, pp. K2-1 to K2-23, undated.
Electrovert Catalog 300-03, pp. 26-32, 1983.

*Primary Examiner*—Paula A. Bradley
*Attorney, Agent, or Firm*—Quarles & Brady

[57] ABSTRACT

A terminal block segment with one pair of feet for mounting on symmetrical tracks of two different widths includes a base with a central portion, two legs spaced from the central portion, and two feet. Each foot includes an inner toe and groove that is spaced from the central portion of the base for receiving an outside edge of a respective rail on a first mounting track and an outer toe and groove that is spaced further from the central portion than the first groove for receiving an outside edge of a respective rail on a second mounting track that is wider than the first mounting track. As one foot is levered off a rail with a screwdriver, various surfaces come into play on the two feet depending on the width of track and whether it is initially contacting the inner toes or the outer toes.

7 Claims, 3 Drawing Sheets

FIG. 6
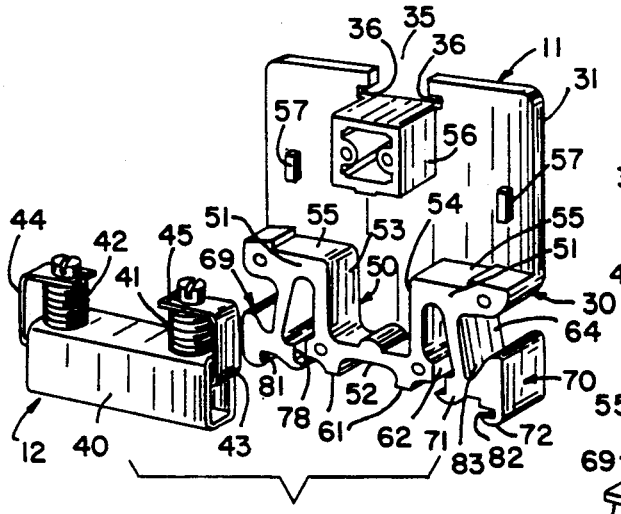
FIG. 7
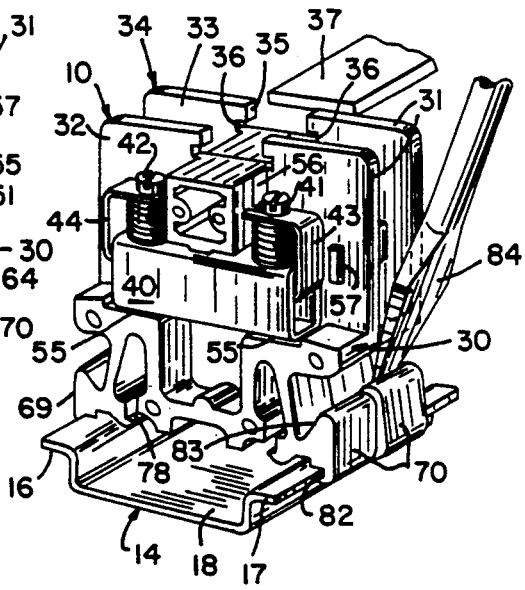
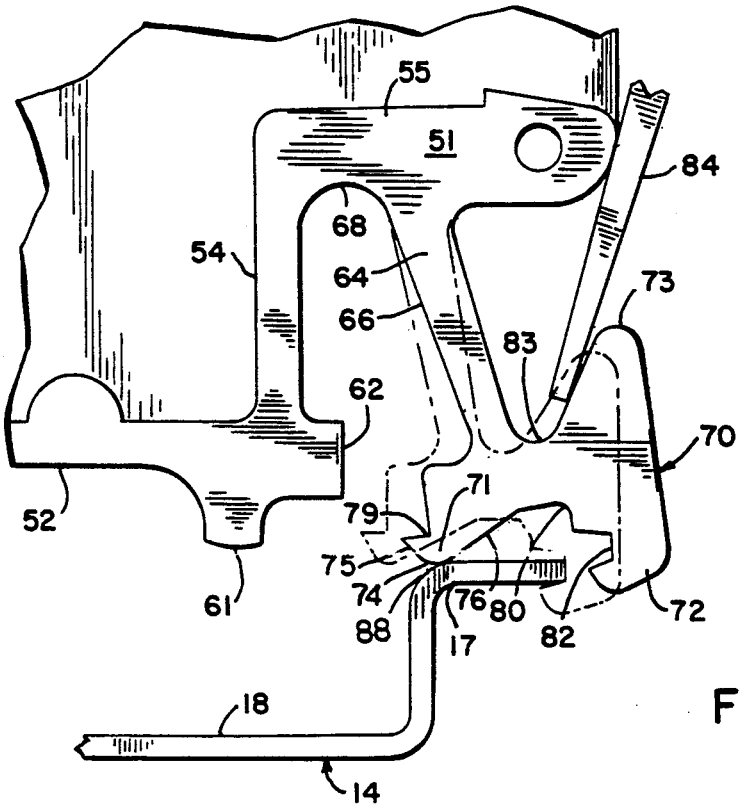
FIG. 8

FIG. 9
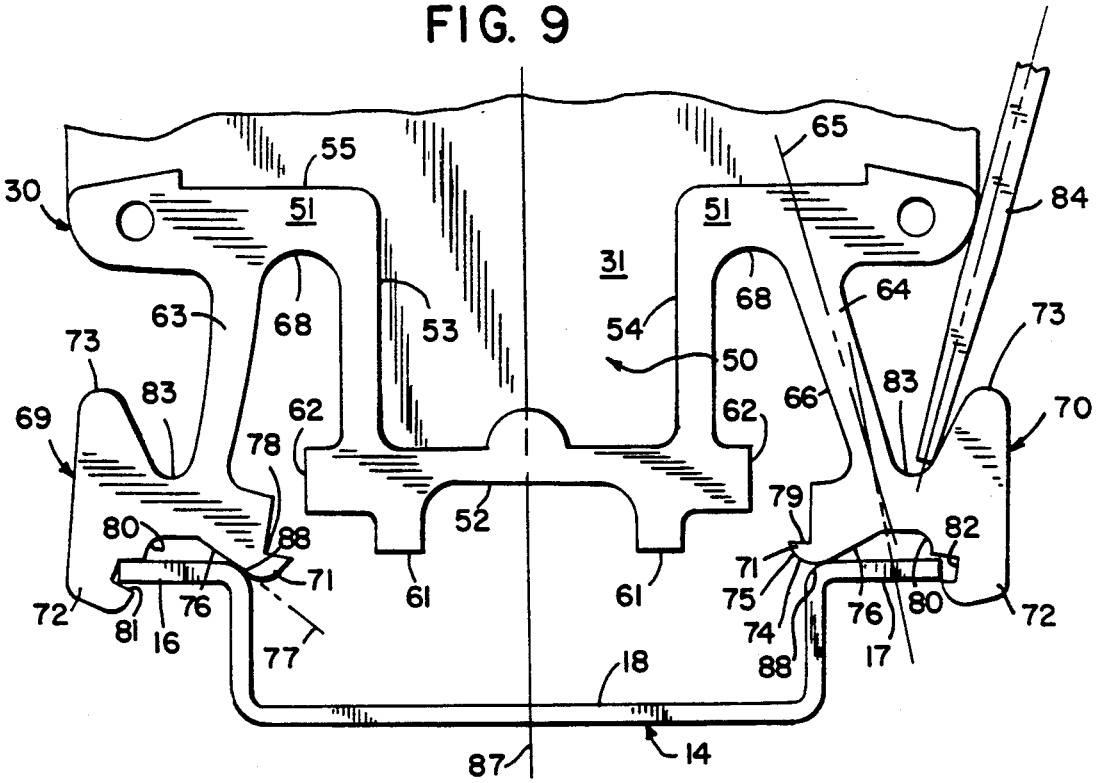
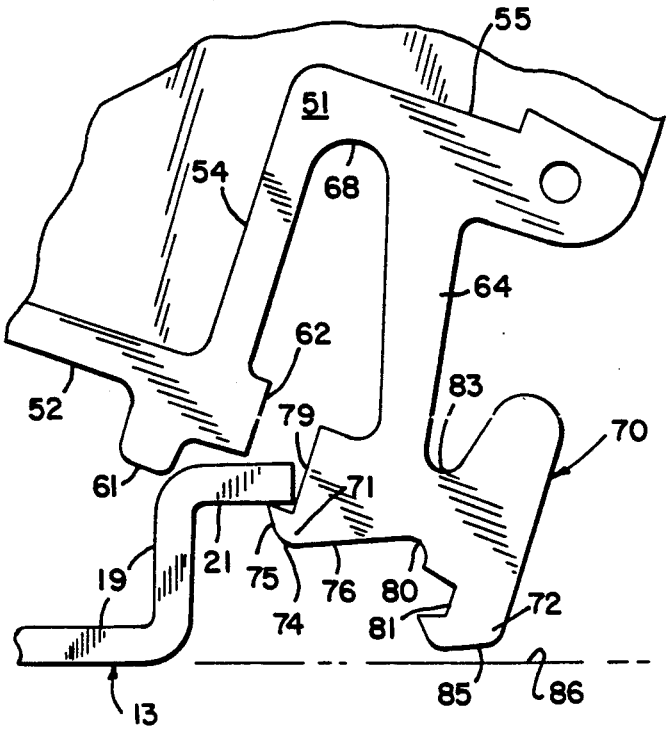
FIG. 10

TERMINAL BLOCK SEGMENT WITH FEET FOR MOUNTING ON TRACKS OF TWO DIFFERENT WIDTHS

BACKGROUND OF THE INVENTION

1. Field of the Invention

The invention relates to track-mounted terminal blocks, and more particularly, to a terminal block segment for mounting on more than one mounting track.

2. Description of the Background Art

De Smidt, et al, U.S. Pat. No. 3,236,975, shows a classic example of a track-mounted terminal block formed of individual segments. Each segment, when abutted with an adjoining segment, forms a compartment for one feedthrough wiring terminal for connecting two or more wires. A number of these segments are slidably mounted on a track and an end barrier is added to close the compartment on the last segment.

In recent years, tracks of various configurations and sizes have been used for mounting such terminal block segments. One type of track includes a channel-shaped member and laterally extending flanges which form a pair of spaced apart rails.

It is known to mount terminal block segments on tracks of two different configurations. One of these tracks is asymmetrical and the feet, which attach to the rails of this track, are also asymmetrical and separate from a second pair of feet which attach to a symmetrical track.

Terminal block segments which are symmetrical and which attach to symmetrical tracks typically have feet adapted for mounting on a track of one particular width. Symmetrical mounting is a desirable feature in a terminal block because it allows installation or removal from either side of a track —a particular advantage inside a densely packed electrical equipment enclosure. An example of a symmetrically mounted segment is illustrated and described in De Smidt, et al., cited above. When such a segment is removed from the track, one foot pivots on the outside of one rail, as the opposing foot is pulled off the outside of an opposing rail.

An object of the invention is to provide a segment that will symmetrically mount on a track of the type disclosed in De Smidt, et al., as well as one or more tracks specified under the DIN standard.

SUMMARY OF THE INVENTION

The invention is incorporated in a terminal block segment with one pair of feet for mounting on symmetrical tracks of two different widths.

More specifically, the segment includes a base with a central portion, two legs spaced from the central portion, and two feet. Each foot includes an inner toe defining a first, inwardly opening groove that is spaced from the central portion of the base for receiving an outside edge of a respective rail on a first mounting track, so that the foot may cooperate with the central portion to hold the segment on a respective rail of the first mounting track. Each foot also includes another toe defining a second, inwardly opening groove that is spaced further from the central portion than the first groove for receiving an outside edge of a respective rail on the second mounting track that is wider than the first mounting track.

While segments have been known to mount on asymmetrical tracks of one width and symmetrical tracks of another width, this is first known segment to symmetrically mount on symmetrical tracks of at least two widths using only one pair of feet.

In a more particular aspect of the invention, a surface is provided between the inner toe and the outer toe which serves as a camming surface on one side and a pivot or stop on the other side as the segment is removed from the second or wider track. Unlike the action relative to the first track, this causes an advantageous pivoting off the inside rail of the wider track.

The segment may be mounted in either small or large numbers to form a short terminal block or long terminal strip in an electrical equipment enclosure.

Other objects and advantages, besides those discussed above, will be apparent to those of ordinary skill in the art from the description of the preferred embodiment which follows. In the description, reference is made to the accompanying drawings, which form a part hereof, and which illustrate examples of the invention. Such examples, however, are not exhaustive of the various embodiments of the invention, and, therefore, reference is made to the claims which follow the description for determining the scope of the invention.

BRIEF DESCRIPTION OF THE DRAWINGS

FIG. 6 is an exploded view in perspective of the terminal block segment of FIGS. 1 and 2;

FIG. 7 shows a pair of terminal block segments mounted on the second track; and FIG. 8 is an enlarged detail view illustrating the act of removal of the terminal block segment from the second track;

FIG. 9 is an enlarged detail view of the segment feet partially removed from the second track; and FIG. 10 is an enlarged detail view illustrating removal of the terminal block segment from the first track.

DETAILED DESCRIPTION OF THE PREFERRED EMBODIMENT

Figure 1:
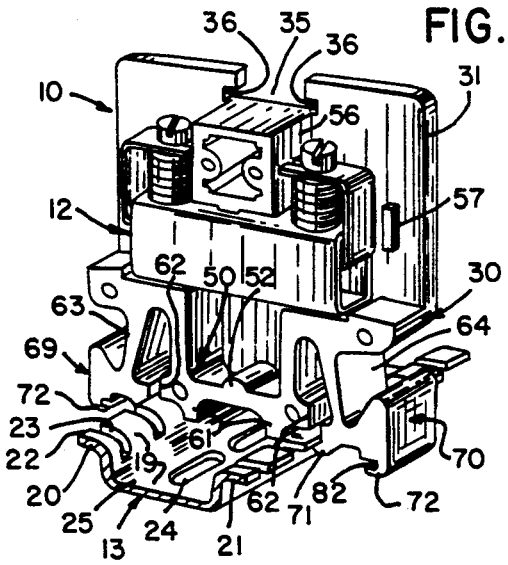
FIG. 1 is a perspective view of an individual terminal block segment mounted on a first track.
Figure 2:
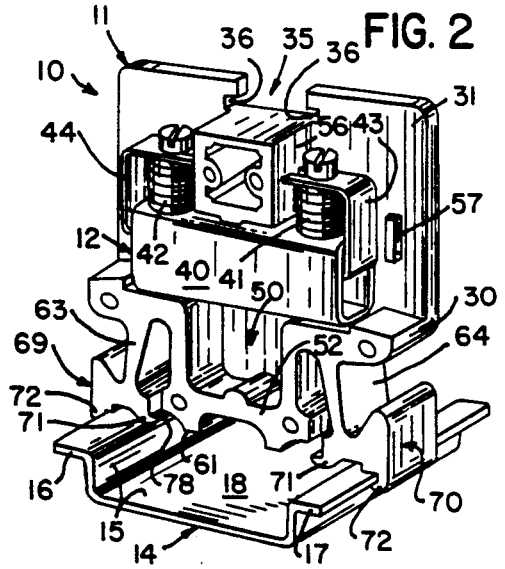
FIG. 2 is a perspective view of the individual terminal block segment of FIG. 1, mounted on a second track.

Referring to FIGS. 1 and 2, the invention is incorporated in a terminal block segment assembly 10 which includes a terminal block segment body 11 (FIG. 3) and a wire terminal assembly 12. The terminal block assembly 10 may be mounted on either one of two tracks 13, 14 seen in FIGS. 1 and 2. The narrower mounting track 13 in FIG. 1, is of the type described in De Smidt et al., U.S. Pat. No. 3,236,975. The wider mounting track 14 in FIG. 2 has a configuration and dimensions determined by the DIN, IEC and CENELEC standards. Preferably, track 14 is a 35 mm DIN "hat" rail. The track 14 has a depth of 7.5 mm, however, a 35×15 mm track can also be used.

The DIN-standard track 14 has a channel member 15 with horizontally extending flanges that form a pair of spaced apart rails 16, 17 running in a longitudinal direction. The track 14 has oblong holes (not shown) in the web 18 of its channel member 15 for mounting the track 13 in an electrical equipment enclosure.

As seen in FIG. 1, the narrower track 13 also has a channel member 19 with horizontally extending flanges that form a pair of spaced apart rails 20, 21 running in a longitudinal direction. These rails 20, 21 are each separated into segments 22 by a plurality of transverse slots 23 spaced longitudinally along the rails 20, 21. The channel member 19 has oblong holes 24 in its web 25 for mounting the track 13 in an electrical equipment enclosure.

The terminal block segment body 11 is integrally molded in a complex shape from a plastic material as specified in U.S. Pat. No. 4,637,676, col. 3, lines 17–20. The body 11 includes a base 30 and a transverse barrier member 31 rising upwardly from a back side of the base 30 as seen in FIG. 7 to separate one terminal compartment 32 from another such compartment 33 on a neighboring segment 34. The barrier members 31 have rectangular notches 35 in their top edges and side niches 36 within the notches to receive a marker identification strip 37 that is inserted through a set of parallel barrier members 31 to secure and identify a group of segments 10, 34 as forming a terminal block assembly. An additional end wall piece (not shown) is used to enclose the compartment 32 on the end terminal block segment 10.

Referring to FIG. 6, the pieces of the wire terminal assembly 12 are made of a suitable conductive metal. The assembly includes a rectangular tube member 40 for feedthrough wiring connections. The tube member 40 has openings in a top wall for receiving threaded wire terminal fasteners 41, 42. The tube also has threads formed internally (not shown) to receive these fasteners 41, 42. A pair of C-shaped contact blades 43, 44 are positioned with one free end inserted in one end of the tube 40. On each contact blade 43, 44, the top end of the "C" is forked, and forms a clip 45 that engages the head of a respective fastener 41. When the fastener 41 is threaded into the tube 40, it urges the contact blade 43 downward, so that the free end portion inserted in one end of the rectangular tube 40 will bear down and secure the bare end of a wire (not shown). The C-shaped blades 43, 44 are an optional feature. Fasteners 41, 42 alone may be used to clamp the wires in the tube 40.

Returning to FIGS. 1 and 2, the base 30 has a cross sectional thickness dimension running in the longitudinal direction of the track 14, and this shall be considered the longitudinal direction of the terminal segment 10. The direction running across the track 14 from one rail 16 to the other 17 shall be referred to as the transverse direction for the terminal segment 10. The third dimension relative to the terminal segment 10 is a vertical dimension or height.

Figure 3:
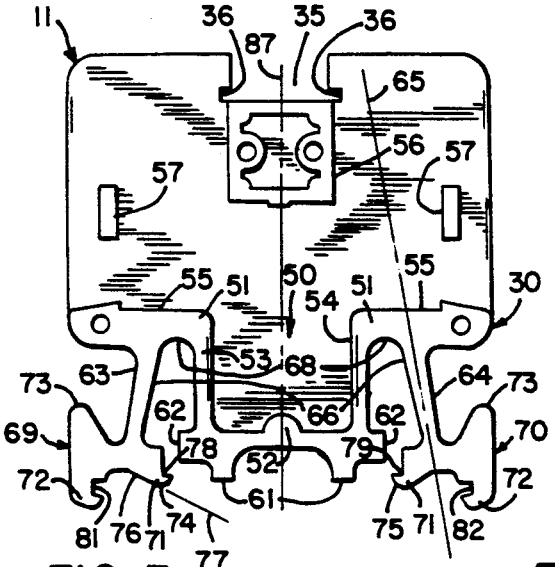
FIG. 3 is a front view of the terminal block segment body as seen in FIGS. 1 and 2.

Referring to FIGS. 3 and 6, the base 30 has a central channel portion 50 and pedestal portions 51 extending laterally from the central portion 50. The central portion 50 has a bottom 52 and two spaced apart sidewalls 53, 54 rising from the bottom 52. The pedestal portions 51 have depressions molded in a top surface to form seats 55 for the wire terminal assembly 12.

As seen from FIGS. 1, 2, 6 and 7, the wire terminal assembly 12 is slidably mounted on the seats 55 to bridge the channel of the central portion 50. The assembly 12 is held in place by a square post 56 that projects from the barrier wall 31 into a space between the threaded fasteners 41, 42 and contact blades 43, 44. In addition, small stops 57 project from the barrier 31 at locations spaced a short lateral distance from each end of the tube 40, so as to help prevent the wire terminal assembly 12 from sliding laterally.

As seen in FIGS. 1–3, a pair of L-shaped guides run longitudinally along the bottom 52 of the central portion 50 and are spaced apart from one another. Each guide has a depending locator portion 61 for locating the segment 10 on opposite inside edges of spaced apart rails 20, 21 of the narrower mounting track 13. Each guide also has a laterally extending support 62 for supporting the segment on the rails 20, 21.

As seen best in FIG. 3, the two legs 63, 64 are spaced laterally from the central portion 50 and depend from the respective pedestal portions 51. The legs 63, 64 taper from a wider portion of 0.080 inches thickness at the top to a narrower portion of 0.050 inches at the ankle. As seen in FIG. 3, a lengthwise axis 65 of each leg is disposed at approximately 10° from vertical.

An inside surface 66 of each leg 63, 64 is separated from a respective sidewall 53, 54 of the base 50 by a space defined in part by arches 68 of radius 0.056 inches that extend from the top of the sidewalls 53, 54 to the top of the respective legs 63, 64.

Each leg 63, 64 has a foot 69, 70 on its lower portion. Each foot 69, 70 has an inner toe 71, an outer toe 72 and a heel 73. The inner toe 71 is rounded in shape with an apex 74, a toe lead-in surface 75 forward of the apex, and a toe camming surface 76 rearward of the apex 74 when seen in a transverse view. The camming surface 76 is parallel to an axis 77 rotated upwardly at an angle of 29° from horizontal. As seen in FIG. 3, the toe 71 on the left foot 69 has a groove 78 of L-shaped cross section that runs longitudinally along the rails of the track 14 as seen in FIG. 2 (the foot and toe having a longitudinal thickness).

As seen in FIGS. 9 and 10, the groove 79 on the right side is the same shape but is reversed to face inwardly toward the central portion 50. The grooves 78, 79 are suitably spaced from the central portion 50 of the base 30 for receiving outside edges of the respective rails 20, 21 on the narrower mounting track 13. The inner toes 71 cooperate with elements 61, 62 to clamp the base 30 on the rails 20, 21 of the narrower mounting track 13.

The camming surface 76 on each foot 69, 70 extends laterally outward into a recess 80 and the foot 69, 70 then curves around and down into the outer toe 72 which has grooves 81, 82 of rectilinear cross section which are suitably spaced on opposite sides of the central portion 50 of the base 30 for receiving outside edges on the rails 16, 17 on the wider mounting track 14.

Each foot 69, 70 extends upwardly from the outer toe 72 to a curved heel 73 which is spaced from the lower portion of a respective leg 63, 64 to provide a V-shaped trough 83.

As seen in FIGS. 8 and 9, a tip 84 on a screwdriver can be inserted into the trough 83, and used as a lever against a side of a respective pedestal 51 to move the foot 70 off a near rail 17 on track 14. When this happens, the camming surface 76 on foot 70 slides over the edge 88, while on the other side, as seen in FIG. 9, camming surface 76 on foot 69 is urged down against the inside edge 88 of the rail 16 and serves as a pivot point. In some cases, where the DIN track 14 is larger in dimension, but within the standard, the camming surface 76 on foot 70 will cause the lower portion of the leg 64 to flex in such a manner so as to allow the removal of the foot 70 from rail 17. The axis 65 of the leg 64 assumes an S-shape during this flexing as indicated in part by the line intersecting axis 65 in FIG. 9.

As seen in FIG. 10, the outer toes 72 are limited in their downward extent and provided with flats 85 that prevent interference with a supporting surface 86 when the foot 70 is pivoted off the narrower track 13.

Figure 5:
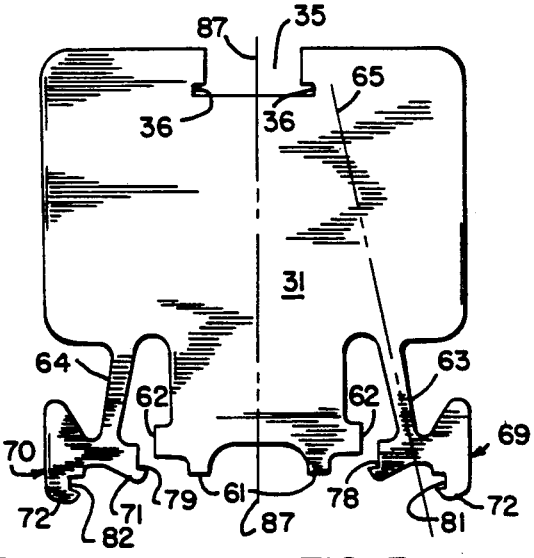
FIG. 5 is a rear view of the terminal block segment seen in FIG. 3.
Figure 4:
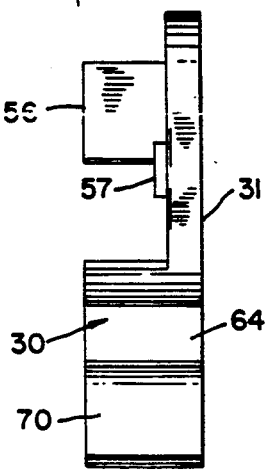
FIG. 4 is a right edge view of the terminal block in FIG. 3, the left edge view being a mirror image thereof.

It should also be noted that the terminal block segment body 11, the wire terminal assemblies 12, and the tracks 13, 14 are symmetrical with respect to a vertical plane bisecting these elements 11–14 and identified by reference 87 in FIGS. 3, 5 and 9.

This description has been by way of example of how the invention can be carried out. Those of ordinary skill in the art will recognize that various details may be modified in arriving at other detailed embodiments, and that many of these embodiments will come within the scope of the invention.

Therefore, to apprise the public of the scope of the invention and the embodiments covered by the invention, the following claims are made.

We claim:

1. A modular segment for attachment to either a first mounting track or a second mounting track, the segment comprising:

a base having a central portion, having pedestal portions extending laterally from the central portion, having a transverse barrier rising upwardly from a back side of the central portion and pedestal portions to separate one terminal compartment from another terminal compartment on a neighboring segment, and having legs depending from the respective pedestal portions so as to be spaced laterally from the central portion and from each other;

a pair of guides running longitudinally along a bottom of the central portion and spaced apart from one another for locating the segment on opposite inside edges of spaced apart rails of the first mounting track;

a pair of feet, each foot being disposed on a lower portion of a respective one of the legs, each foot including two toes, the two toes including a first toe with a first, inwardly opening groove that is spaced from the central portion of the base for receiving an outside edge of a respective rail on the first mounting track and cooperating with a respective one of the guides to hold the segment on a rail of the first mounting track; and the foot also including a second toe with a second, inwardly opening groove that is spaced further from the central portion than the first groove for receiving an outside edge of a respective rail on the second mounting track that is wider than the first mounting track.

2. The segment of claim 1, wherein the first toe has an inner curved surface and an outer curved surface that extends into an upwardly angled camming surface; and wherein the camming surface is angled so that as the segment is being pulled off a near rail on the second track, the camming surface slides over the near rail and causes the leg to flex in such a manner that it clears the rail; and wherein on an opposite side of the segment, the camming surface is angled to contact an inside edge of the far rail to provide a pivot point during removal of the segment from the second track.

3. The segment of claim 1, wherein at least one foot also includes an upwardly directed heel that defines a trough between the heel and a respective one of the legs in which a tool can be inserted against a side of a respective pedestal to lever the foot off a near rail on a respective one of the mounting tracks.

4. The segment of claim 1, wherein the legs and feet are disposed symmetrically on either side of a vertical plane bisecting the base so as to symmetrically mount on symmetrical tracks of two different widths.

5. The segment of claim 1, wherein the inner toe and outer toe are integral portions of each foot.

6. The segment of claim 1, further comprising means disposed on the base for electrically connecting two wires.

7. A modular segment for attachment to either a first mounting track or a second mounting track, the segment comprising:

a base having a central portion, having pedestal portions extending laterally from the central portion, having a transverse barrier rising upwardly from a back side of the central portion and pedestal portions to separate one terminal compartment from another terminal compartment on a neighboring segment, and having legs depending from the respective pedestal portions so as to be spaced from the central portion;

a pair of guides running longitudinally along a bottom of the central portion and spaced apart from one another for locating the segment on opposite inside edges of spaced apart rails of the first mounting track;

a foot on a lower portion of each respective leg, the foot including a first toe with a first, inwardly opening groove that is spaced from the central portion of the base for receiving an outside edge of a respective rail on the first mounting track and cooperating with a respective one of the guides to hold the segment on a rail of the first mounting track;

the foot also including a second toe with a second, inwardly opening groove that is spaced further from the central portion than the first groove for receiving an outside edge of a respective rail on the second mounting track that is wider than the first mounting track; and the first toe has an inner curved surface and an outer curved surface that extends into an upwardly angled camming surface; and wherein the camming surface is angled so that as the segment is being pulled off a near rail on the second track, the camming surface slides over the near rail and causes the leg to reflex in such a manner that it clears the rail; and wherein on an opposite side of the segment, the camming surface is angled to contact an inside edge of a far rail to provide a pivot point during removal of the segment from the second track.

* * * * *

UNITED STATES PATENT AND TRADEMARK OFFICE

CERTIFICATE OF CORRECTION

PATENT NO. : 5,145,418

DATED : September 8, 1992

INVENTOR(S) : Jeffrey A. Moranski, et al.

It is certified that error appears in the above-identified patent and that said Letters Patent is hereby corrected as shown below:

Col. 6, line 56 "reflex" should be --flex--.

Signed and Sealed this

Twenty-first Day of December, 1993

*Attest:*

BRUCE LEHMAN

*Attesting Officer*

*Commissioner of Patents and Trademarks*